United States Patent [19]

Anderson

[11] Patent Number: 4,830,325

[45] Date of Patent: May 16, 1989

[54] HANGER OF UNFRAMED ART AND THE LIKE

[76] Inventor: Rickie J. Anderson, 1373, Clinton, Miss. 39056

[21] Appl. No.: 77,013

[22] Filed: Jul. 24, 1987

Related U.S. Application Data

[63] Continuation-in-part of Ser. No. 920,965, Oct. 20, 1986, abandoned.

[51] Int. Cl.[4] ..... A47F 7/14

[52] U.S. Cl. ..... 248/475.1; 40/152.1; 248/216.1; 248/328; 248/490; 248/493

[58] Field of Search ..... 248/475.1, 489, 490, 248/493, 497, 498, 216.1, 217.1, 328; 40/152, 152.1

[56] References Cited

U.S. PATENT DOCUMENTS

| | | | |
|---|---|---|---|
| 140,851 | 3/1873 | Simpson . | |
| 821,159 | 10/1905 | Feldman . | |
| 1,039,367 | 7/1911 | Dehn . | |
| 1,065,360 | 6/1913 | Fuller . | |
| 1,223,802 | 6/1916 | Kuhn . | |
| 1,297,584 | 12/1918 | Mock . | |
| 1,314,548 | 11/1918 | Taylor . | |
| 1,413,833 | 1/1920 | David . | |
| 1,651,392 | 6/1926 | Honigbaum . | |
| 1,812,254 | 10/1927 | Boswell . | |
| 1,914,951 | 6/1933 | Kiessling | 248/498 |
| 2,317,204 | 11/1942 | Lowenthal . | |
| 2,606,730 | 5/1950 | Bryn | 248/497 |
| 3,788,588 | 1/1974 | Tendler | 248/475.1 X |
| 4,085,917 | 4/1976 | Brantley | 248/489 |
| 4,333,625 | 6/1982 | Haug | 248/216.1 |
| 4,413,803 | 11/1983 | Ross | 248/475.1 |
| 4,566,665 | 1/1986 | Rynearson | 248/493 X |
| 4,611,780 | 9/1986 | Robertson | 40/152.1 X |
| 4,641,441 | 2/1987 | Roth | 40/152.1 |

*Primary Examiner*—Ramon O. Ramirez

*Attorney, Agent, or Firm*—Dewitt L. Fortenberry, Jr.

[57] ABSTRACT

A picture hanging device particularly designed for hanging framed and unframed pictures and artwork. The picture hanging device is designed so that it is easily attachable to the backing of a picture and a wire can be looped over a nail or screw inserted in a wall so that the picture will hang in a substantially vertical position. The device comprises a body having tapered arms extending upwardly until said arms come to substantially a point, and a plurality of holes; and a wire looped through said holes. At least one side of said body and arms form a substantially vertical plane, and at least two sides of said body extend outwardly and downwardly away from said body.

5 Claims, 3 Drawing Sheets

HANGER OF UNFRAMED ART AND THE LIKE

This invention is a continuation-in-part of my U.S. Application Ser. No. 920,965, filed Oct. 20, 1986, now abandoned and titled Hanger of Unframed Art and the Like.

BACKGROUND OF THE INVENTION

This invention relates to a device for hanging pictures and in particular, unframed pictures and artwork. Throughout the description herein, it is understood that the term picture as well as the term artwork are interchangeable and include any item which is desired to be hung on a wall.

Over the years, various devices have been used for hanging pictures. Generally, such devices can be categorized in five separate areas of prior art. The first area of prior art is represented by U.S. Pat. No. 821,159 and U.S. Pat. No. 1,066,350 both of which disclose a pin, inserted into the backside of a picture, and having an eye to hang on a nail extending from a wall. The '350 patent also discloses a piece of sheet metal having a point that goes into the picture, two side pieces that are bent up to block the picture from touching the wall, and a semi-circular hook that goes around a nail from which to hang the picture by. The '159 patent also discloses a hanger for picture frames that has an eye and loop connected to a nail or screw portion that sticks directly into the picture frame.

The second area of prior art is represented by U.S. Pat. No. 1,039,367; U.S. Pat. No. 1,297,594; U.S. Pat. No. 1,314,548; and U.S. Pat. No. 1,413,833 all of which basically disclose a pin that sticks into the picture and another pin that sticks into the wall.

The third type of prior art is represented by U.S. Pat. No. 140,851; U.S. Pat. No. 1,812,254; and U.S. Pat. No. 4,085,917 all of which relate to devices having a piece of wire with pins sticking into the picture or frame and an eye by which the painting can be suspended by a nail or hook.

The fourth type of prior art is represented by U.S. Pat. No. 1,651,392; U.S. Pat. No. 1,223,802; and U.S. Pat. No. 2,606,730. These devices tend to be more solid as opposed to merely a piece of wire. They are either stuck or nailed into a picture and hung by some type of eye or hook with a nail attached to the wire.

The fifth type of prior art is represented by U.S. Pat. No. 2,317,304 which discloses a hanging device which has an eye to hang on the wall and said device is tapered with a larger end away from the eye which attaches to a picture.

Although each of the above patents disclose a device for hanging pictures, this invention is unique and its differences will become evident upon a reading of the claimed matter herein.

SUMMARY OF THE INVENTION

The invention disclosed herein is unique in that it can be used to hang both framed and unframed pictures and artwork safely, without damaging the picture. The invention is also reusable and easily interchangeable from picture to picture.

It is therefore an object of this invention to provide a device capable of hanging pictures and in particular, unframed pictures.

An object of this invention is also to provide a picture hanging device which is reusable.

Another object of this invention is to provide a picture hanging device which is easy and simple to use.

A further object of this invention is to provide a picture hanging device which is simple in construction and relatively inexpensive to manufacture.

Another object of the invention is to provide a picture hanging device which will retain a picture in a relatively vertical position against a wall for an indefinite period of time.

It is also an object of this invention to provide a picture hanging device which will not puncture or damage the artwork to be hung from a wall.

These and other objects of this invention will become readily apparent upon a reading of the detailed description of the preferred embodiment of the invention.

DETAILED DESCRIPTION OF THE PREFERRED EMBODIMENT OF THE INVENTION

Figure 1:
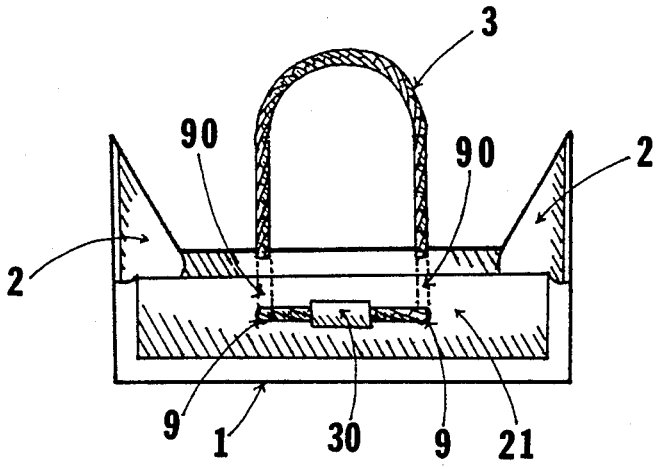
FIG. 1 is a front view of the preferred form of the invention.

Referring now to FIG. 1, the invention consists of a body 1 having a plurality of arms 2 and a wire 3. The arms 2 are designed so that each is tapered to substantially a point at the end opposite the body 1. Said body 1 also consists of a frontside 21 and a backside 11 as well as a plurality of holes 9 extending through said body 1 from said front side 21 to said back side 11. Each of said holes 9 are also in communication with separate recessed grooves 90 located in the backside 11 of said body 1. In this embodiment, said wire 3 is looped through said holes 9 and interconnected with a fastener 30. The wire 3 is therefore capable of being accepted into said recessed grooves 90.

Figure 2:
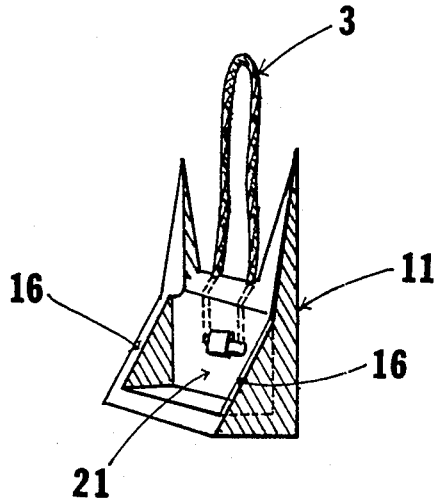
FIG. 2 is a side perspective of the preferred form of the invention as shown in FIG. 1.

In the preferred embodiment, the body 1 is constructed so that the outermost vertical sides 16 of the front side 21 extend and slant in a substantially outward and downward direction. The backside 11 of said body 1 and said arms 2 remain, however, in a substantially vertical plane. The slant of said outermost horizontal sides 16 and the relationship to the backside 11 is indicated in FIG. 2.

Figure 3:
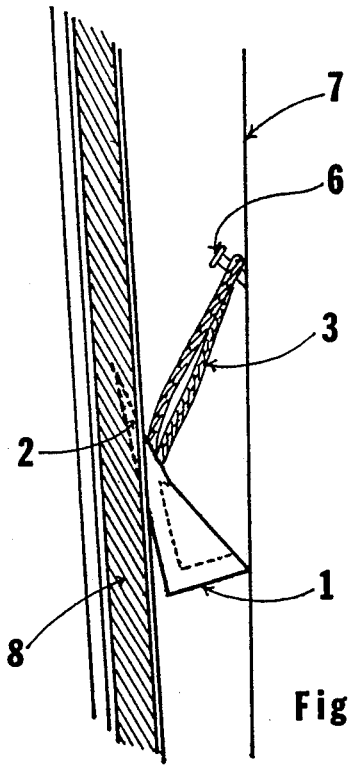
FIG. 3 is a side view of the preferred form of the invention as it is used to hang a picture on a wall.
Figure 4:
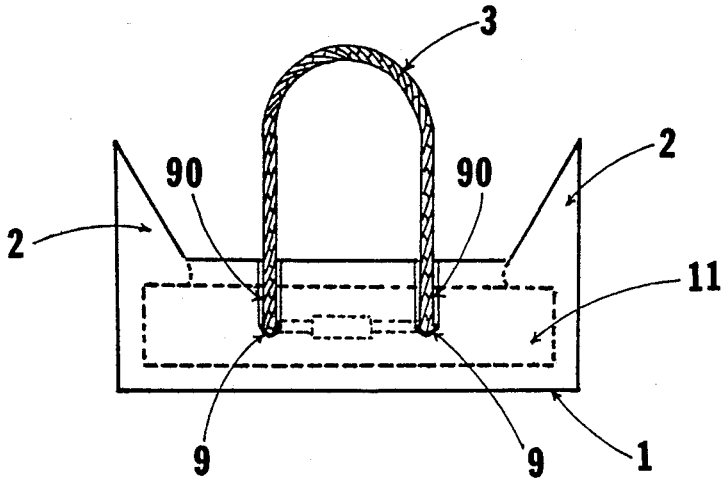
FIG. 4 is a back view of the preferred form of the invention.
Figure 5:
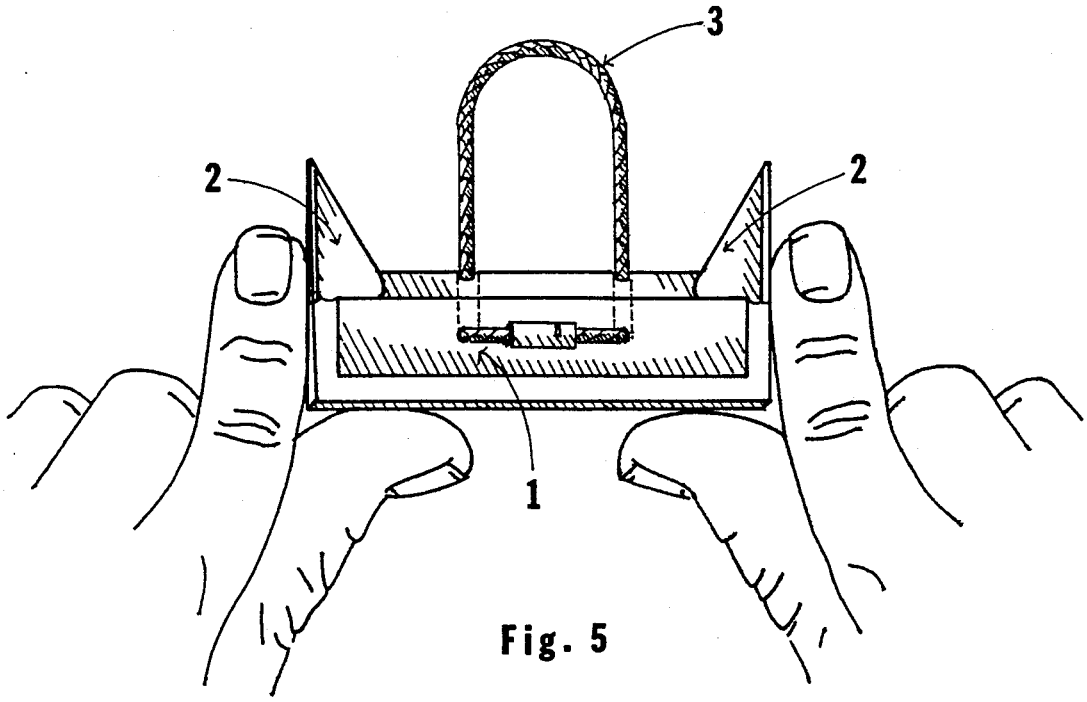
FIG. 5 is a view of the invention indicating how it is inserted in the backing of a picture.

Referring to FIG. 3 and FIG. 5, when it is desired to hang a picture, the point of each arm 2 is pushed in an upward direction and inserted into the cardboard backing 8 of a picture so that the backside 11 of the body 1 is substantially against said backing 8. It should be noted that in this position the wire 3 is accepted into grooves 90 thereby allowing the backside 11 to be inserted against the backing 8. The wire 3 is then looped over a nail, screw or hook 6 which is driven into a wall 7 and the picture is hung.

It is very important to note that because the backside 11 is substantially smooth and vertical, when this device is inserted into the cardboard backing 8 as indicated in FIG. 3, the arms 2 cannot be accidentally pushed through said backing 8 which would damage the picture to be exhibited.

The invention has been described with particular reference to a preferred embodiment, but it will be understood that variations and modifications within the spirit and scope of the invention may occur to those skilled in the art to which the invention pertains.

I claim:

1. A device for hanging framed and unframed pictures and the like, comprising a body having tapered arms extending upwardly until said arms come to substantially a point for penetration into backing of a picture, with said body having a plurality of holes through said body, and a wire looped through said holes and connected at its end.

2. The device of claim 1 wherein at least one side of said body and arms form a substantially vertical plane.

3. The device of claim 2 wherein each of said holes are in communication with a recessed groove in the substantially vertical plane of said body.

4. The device of claim 1 wherein at least two sides of said body extend outwardly and downwardly away from said body.

5. A picture hanging device comprising a body having tapered arms extending upwardly until said arms come to substantially a point wherein one side of said body and arms form a substantially vertical plane, said body having a plurality of holes through said body with each of said holes in communication with a recessed grove in the substantially vertical plane of said body, and at least two sides of said body extend outwardly and downwardly away from said body, and a wire looped through said holes and connected at its end.

* * * * *